United States Patent [19]

Tashman

[11] 4,009,838

[45] Mar. 1, 1977

[54] PORTABLE SOLID WASTE SHREDDER

[76] Inventor: Philip Tashman, 11020 SW 75th Court, Miami, Fla. 33156

[22] Filed: Aug. 28, 1975

[21] Appl. No.: 608,468

[52] U.S. Cl. ..... 241/99; 241/100; 241/101.7; 241/236

[51] Int. Cl.[2] ..... B02C 13/02; B02C 13/286

[58] Field of Search ..... 241/99, 100, 101.7, 241/186 R, 187, 190, 222, 223, 224, 236

[56] References Cited

UNITED STATES PATENTS

| | | | |
|---|---|---|---|
| 3,396,914 | 8/1968 | Liebman | 241/187 X |
| 3,490,706 | 1/1970 | Rogers et al. | 241/186 R |
| 3,664,592 | 5/1972 | Schweigert et al. | 241/236 UX |
| 3,687,062 | 8/1972 | Frank | 241/99 X |
| 3,807,296 | 4/1974 | Eck | 241/100 UX |
| 3,880,361 | 4/1975 | Schwarz | 241/236 X |

*Primary Examiner*—Roy Lake
*Assistant Examiner*—Howard N. Goldberg
*Attorney, Agent, or Firm*—Ernest H. Schmidt

[57] ABSTRACT

A portable solid waste shredder for automatically shredding refuse or waste materials including any kind of wet or dry trash, glass, metal cans, cartons, wood, cardboard and particularly synthetic plastics. The device comprises oppositely rotating pluralities of rotary shredding jaws, accessible through an open top or a front opening door, chute means from the rotary jaws to feed the shredded materials from the jaws to a conveyor for discharge through an opening in one side of the shredder housing, and means to collect all liquids from the trash inserted into the shredder device for discharge into a wheeled dolly at the bottom of the shredder device. The shredder device is particularly well adapted for use in combination with a companion compactor by the provision of a discharge opening for the shredded waste at a position, relative to an opening in the side of a compactor, directing the shredded waste materials into the compactor to be compacted and baled along with waste materials directly fed into the compactor.

17 Claims, 8 Drawing Figures

74
82
86
24
32
30
26
76
78
84
78
94
8
6
20
53
52
16
88
92
90
118
114
98
116
132
28
216
172
112
170
102
115
110
170
172
130
128
50
236
180
212
178
234
168
54
232
220
218
224
226
220
222
146
240
126
58
60
158
242
228
174
246
204
214
206
154
127
212
254
210
190
123
123
56
142
252
156
240
62
58
22
8
150
244
22
6
64
68
34
30
46
66
66
44
44

PORTABLE SOLID WASTE SHREDDER

FIELD OF THE PRESENT INVENTION

The portable waste shredder of the present invention relates to solid waste disposal apparatus which is particularly adapted to shred materials which are not readily compactable in their natural forms and/or shapes. For example, many types of plastic widely used containers and receptacles, when disposed of in a compactor, tend to return to their original shape and size after being subjected to a normal compacting operation. Such containers etc., must be shredded to permanently reduce their volume to substantially that of their actual structural materials. The shredder of the present invention, when used in combination with a compactor, greatly increases the amount of waste materials which may be compacted into a single bale where materials such as plastic, glass, etc. would normally be disposed of directly into a compactor.

OBJECTS AND ADVANTAGES OF THE PRESENT INVENTION

The principal object of this invention is to provide a solid waste shredder which substantially reduces normally non-compactable materials to their minimal material volume content.

Another important object of this invention is to provide a solid waste shredder which may be so positioned relative to a companion compactor as to directly discharge the shredded waste materials into the compacting chamber of the compactor.

A further object of the present invention is to provide a solid waste shredder device having oppositely rotating pluralities of rotary shredding jaws which are accessible either through an open top or a front opening door.

Another object of the invention is to provide chute means from the shredding jaws to a conveyor operative to move the shredded materials outwardly through a discharge opening in a side wall of the shredder device.

Yet another object of the invention is to provide, in a shredder device, a generally outwardly-extending flange means delineating the discharge opening, which may be extended into a companionate opening in a side wall of compactor to permit positioning of the shredder in close proximity to the compactor for discharge of shredded materials directly into its compacting chamber.

A still further object of the invention is to provide an enlarged receptacle, beneath the shredding jaws, to receive the shredded materials from the jaws, the conveyor means being mounted in the enlarged receptacle.

Another object of the invention is to provide a liquid catch basin extending downwardly of the bottom of the enlarged receptacle to collect all liquids from containers, etc., shredded in the shredder jaws.

Another object is to provide a drain hose from the catch basin into a drain or into an interior chamber of a dolly positioned beneath the shredder device.

DETAILED DESCRIPTION OF THE DRAWINGS

Figure 1:
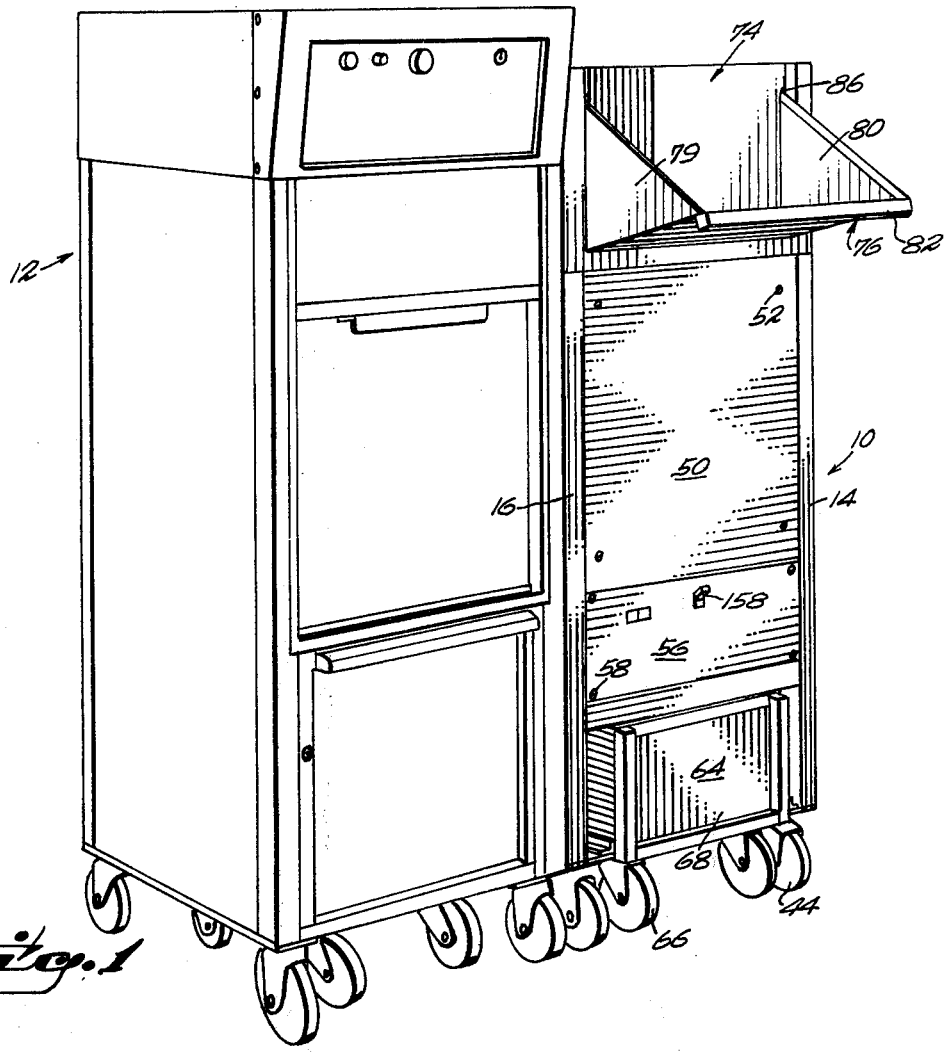
FIG. 1 is a perspective view of a portable solid waste shredder embodying the invention shown in combination with a compactor device.

With reference to the drawings, in which like reference characters designate like or corresponding parts throughout the various views, and with particular reference to FIG. 1, the solid waste shredder of the present invention is indicated generally at 10, positioned relative to a solid waste compactor 12 to discharge the shredded materials into the compacting chamber thereof.

Figure 5:
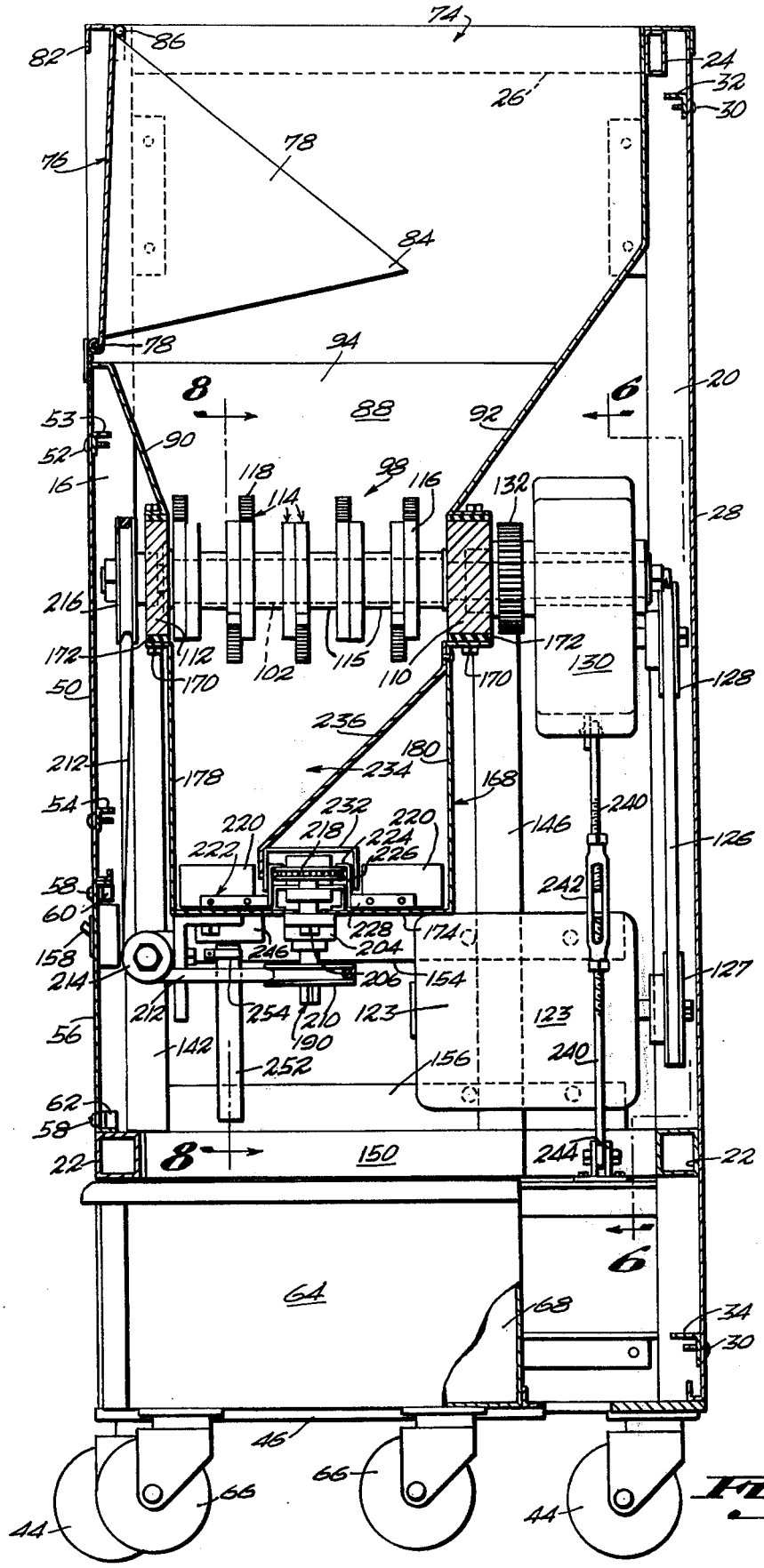
FIG. 5 is a vertical cross-sectional view taken substantially along the line 5—5 of FIG. 3.
Figure 7:
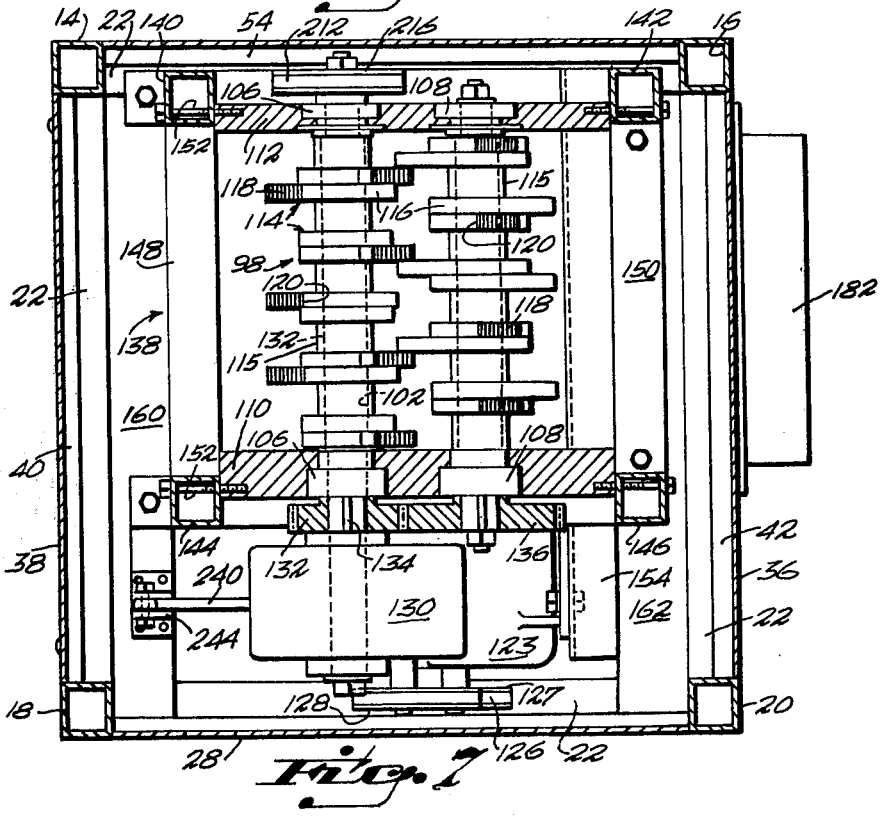
FIG. 7 is a horizontal cross-sectional view taken along the line 7—7 of FIG. 6.

The solid waste shredder includes a main frame, comprised generally of four vertical corner posts, front corner posts 14 and 16 and rear corner posts 18 and 20, all of which are preferably of steel tubing having a generally square cross-section. Similar square tubing members 22 form side-to-side and front-to-back spacing and support for the corner posts, said members being located somewhat upwardly of the bottom of the device (FIGS. 5, 7). The top edges of the two rear corner posts 18 and 20 are interconnected by a frame member 24, and are similary connected to respective front corner posts 14, 16 by frame members 26, (only one shown in FIG. 5).

A rear panel 28 is disposed between the rear corner posts 18 and 20, and is affixed relative thereto by screws 30 engaged through upper and lower angle members 32 and 34 fixed to and spanning the distance between said rear posts, as best seen in FIG. 5. First and second side panels 36 and 38 are similarly fixed to angle members 42 and 40, fixed to and spanning the distance between the corner posts 16 and 20 and the corner posts 14 and 18, respectively. Castor wheels 44 are fitted at the lower ends of the corner posts 14, 16, 18 and 20, being appropriately affixed relative to front-to-back bottom plates 46 and 48.

Figure 3:
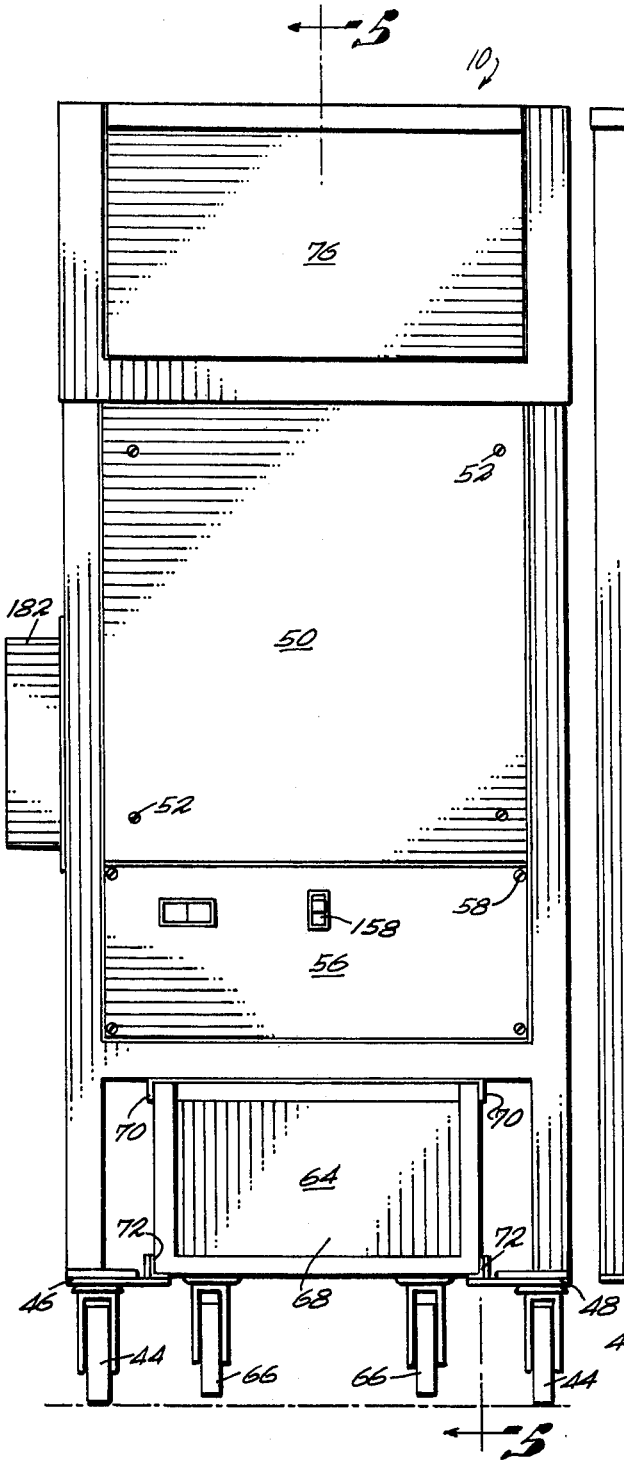
FIG. 3 is a front elevational view of the portable waste shredder, shown separately.

The front of the device includes a main central closure panel 50 fixed by screws 52 to upper and lower angle members 53 and 54 fixed to and spanning the distance between the front corner posts 14 and 16, and a bottom panel 56 fixed by screws 58 to bracket 60 and 62 carried by front corner posts 14 and 16, (see FIGS. 3 and 5). Beneath the frame members 22, the lower front of the device is open to removably receive a dolly 64 equipped with caster wheels 66. The main body portion of the dolly 64 comprises a receptacle 68 for fluids which drain from the shredder device 10, as is hereinafter more fully described. As best illustrated in FIG. 3, the dolly 64, when properly positioned relative to the bottom portion of the shredder, is supported between upper and lower lateral guide track means 70—70 and 72—72, the lower guide means being affixed relative to the top faces of the bottom plates 46 and 48.

With particular reference to FIGS. 1 and 5, the shredder device provides an open top indicated at 74 and a front, top door 76 pivoted at the bottom 78 between the front corner posts 14 and 16. The door 76 is positioned above the front central closure panel 50 and is provided with opposed side wall portions 79 and 80, generally of triangular configuration. The door 76 is balanced to normally remain in the closed position of FIG. 5. When the door 76 is manually opened by means of the top pull 82, the inner apex portion 84 of each side wall portion 79 and 80 engages a top corner abutment 86 to limit the outward swing thereof and to maintain the door in an open position until it is manually closed.

Figure 2:
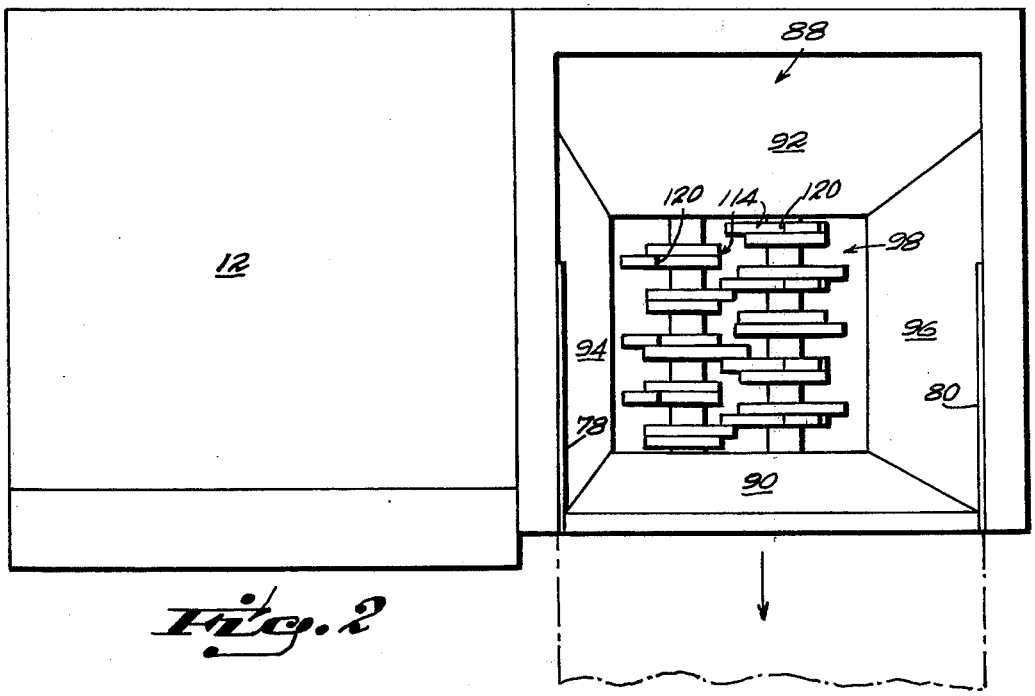
FIG. 2 is a top plan view of the shredder in combination with the compactor device.
Figure 8:
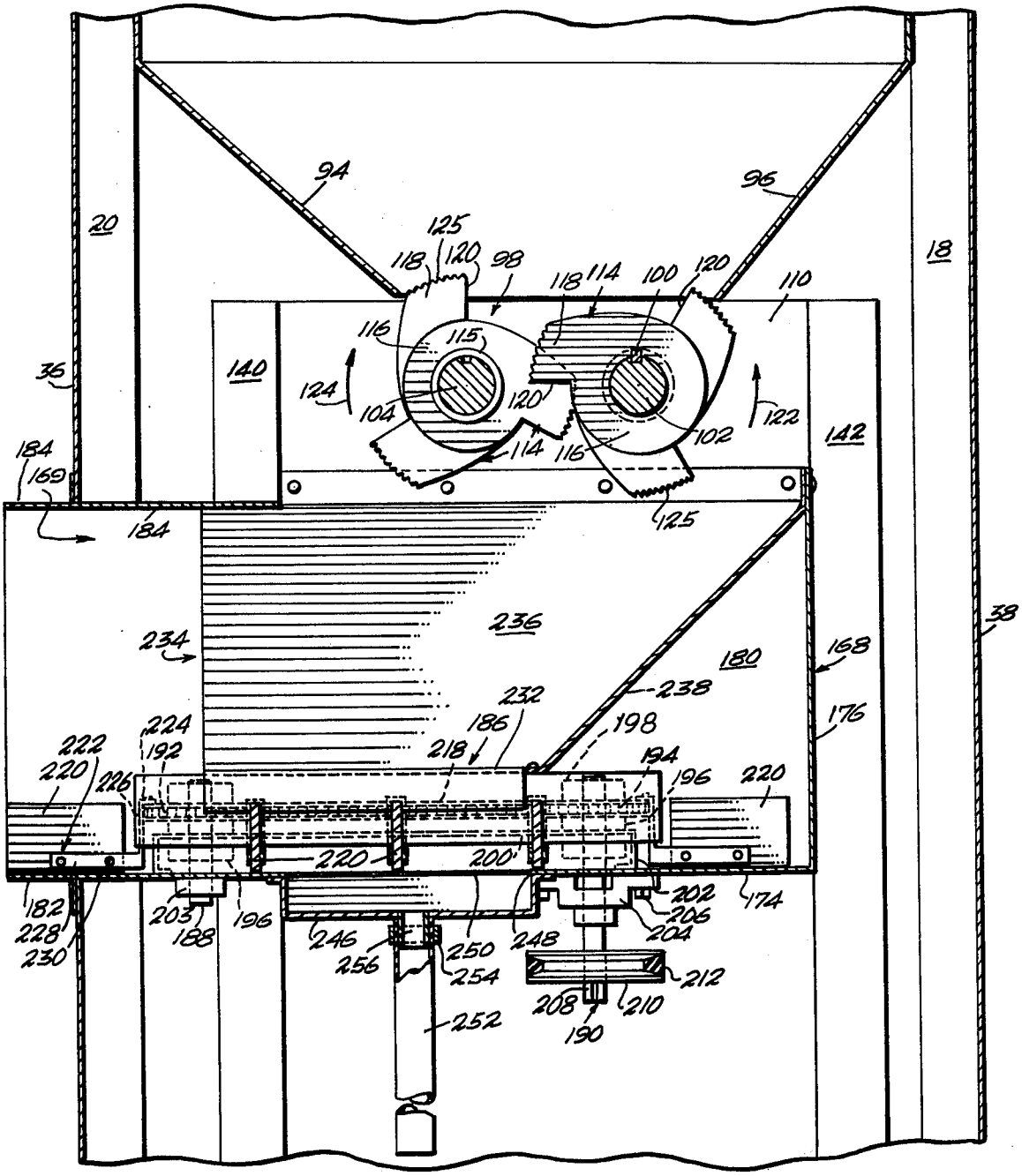
FIG. 8 is a vertical cross-sectional view taken along the line 8—8 of FIG. 5.

As best illustrated in FIGS. 2, 5 and 8, the open top 74 and pivotal door 76 provide access to a first chute 88 comprised of downwardly and inwardly-inclined, front, rear, and opposed side walls 90, 92, 94 and 96. The first chute 88 directs material disposed therein to a rotary shredder jaw assembly generally indicated at 98. With particular reference to FIGS. 5, 7 and 8, the jaw assembly 98 is comprised of two sets of rotary jaws fixed as by any conventional means, such as keys 100, to respective parallel shafts 102 and 104, rotatably journalled in appropriate bearing means 106 and 108 in end plates 110 and 112. The drawings illustrate a preferred arrangement of sets of individual rotary jaws 114 on the respective shafts 102 and 104. Each shaft 102 and 104, as illustrated, fixedly carries ten rotary jaws 114 in abutting side-by-side pairs with a spacer sleeve 115 between each adjacent pair to permit close free passage therebetween of the respective pairs of jaws 114 in registration therewith carried by the opposed shaft 102 or 104. Each individual jaw includes a main body portion 116 and a radially extended lobe 118 providing a leading radial edge 120. As best seen in FIG. 8, the shafts 102 and 104 are spaced apart a distance sufficient to permit the lobes 118 of the various jaws carried by the shafts 102 and 104 to sequentially pass in an overlapping relationship to provide a shearing action on any materials engaged therebetween. As illustrated in FIG. 8 the jaws 114 are rotated in opposed directions, as indicated by the arrows 122 and 124, and the outer peripheral edges thereof are preferably serrated, as at 125.

Referring to FIG. 5 and 7, the shafts 102 and 104 are driven by an electric motor 123 by means of a belt drive 126 engaged between a motor pulley 127 and an input pulley 128 on a speed reducer gear box 130. The gear box directly drives one jaw carrying shaft, such as 102, and a gear 132 fixed as by key means 134 to shaft 102 meshes with a gear 136 similarly fixed to shaft 104. The gears 132 and 136 preferably vary in size to drive the shafts 102 and 104 at different speeds to cause an ever-changing relationship between the rotary jaws 114 carried by the respective shafts. As illustrated, the jaws 114 on each shaft are positioned to present the leading radial edges 120 of the respective jaws in a 120 degree displaced relationship relative to each other. However, this particular arrangement is by way of example only because any one of a variety of other jaw arrangements is equally effective in performing the shredding operation.

Figure 6:
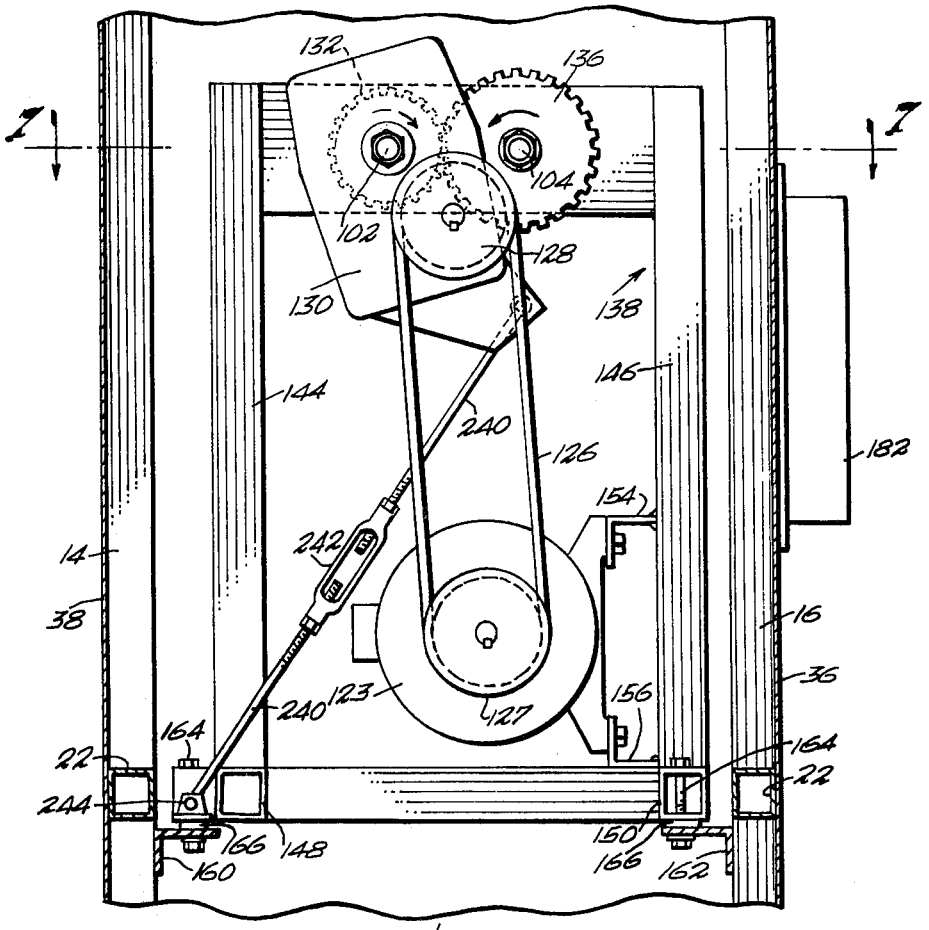
FIG. 6 is a vertical cross-sectional view taken along the line 6—6 of FIG. 5.

With further reference to FIGS. 6 and 7, an inner, secondary frame 138 is provided within the central portion of the housing defined by the corner posts 14, 16, 18 and 20. This secondary frame is comprised of front and back upright corner posts 140, 142 and 144, 146. The respective front and back lower ends of the posts 140, 142, 144 and 146 are rigidly connected by transverse members 148 and 150. The upper ends of the front corner posts 140 and 142 and the upper ends of the back corner posts 144 and 146 are fixed by screw means 152 to the respective front and back end plates 112 and 110. As best seen in FIG. 6, the motor 123 is mounted relative to a pair of transverse angular mounts 154 and 156 fixed as by welding between front and back posts 142 and 146. On-off switch means 158 is provided in the lower panel 56 to control the electric motor 123.

With particular reference to FIG. 6, the four bottom corners of the inner secondary frame 138 are mounted relative to a pair of transverse angle members 160 and 162, fixed as by welding between the respective pairs of front and back corner posts 14, 18 and 16, 20, by nut and bolt means 164. A relatively thick resilient washer 166 is interposed between each connection 164 to isolate any vibration created by the motor 123 and the operation of the shredder jaws assembly 98.

Figure 4:
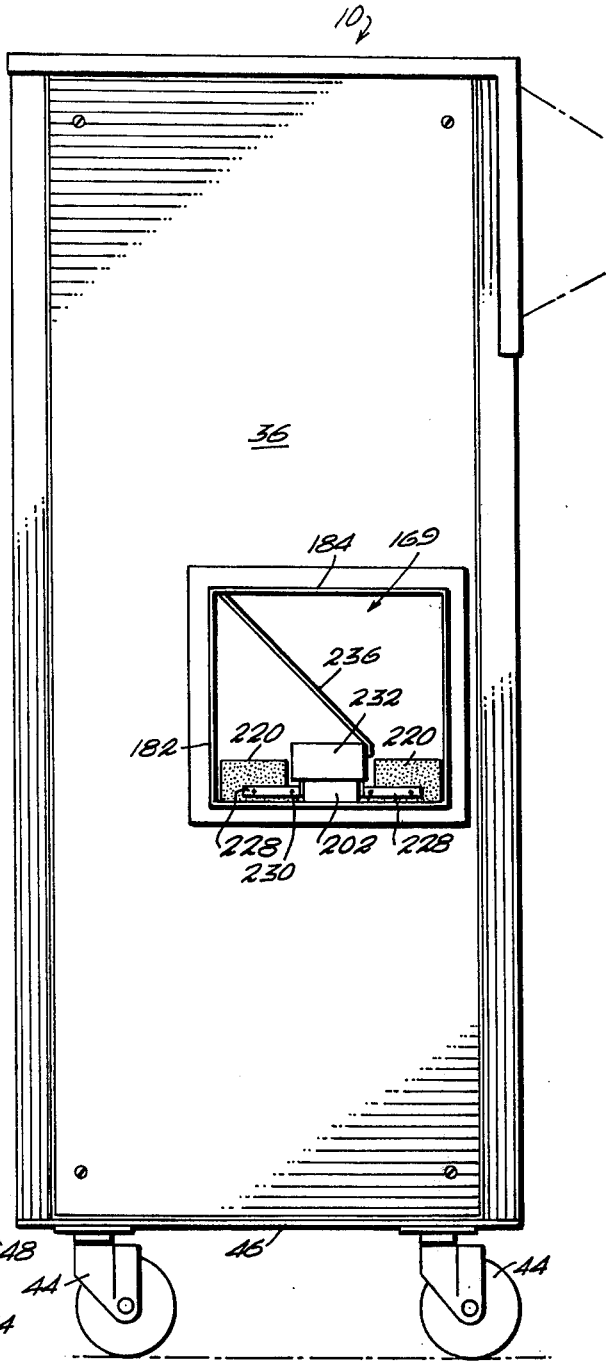
FIG. 4 is a side elevational view of the shredder of FIG. 3.

Referring now to FIGS. 5 and 8, an enlarged receptacle 168 is fixed relative to the bottom edges of the end plates 110 and 112 as by bolt means 170. Resilient washer means 172 may be interposed between each connection to further isolate any vibrations as above described. The enlarged receptacle 168 is generally located beneath the shredder assembly 98, and includes a bottom wall 174, a rear wall 176 and opposed side walls 178 and 180. As best illustrated in FIGS. 4 and 8, the outer end of the receptacle 168 opens at 169 through the first side panel 36 and terminates in a generally outwardly-projecting, rectangular flange portion 182. An outer top wall portion 184 completes the rectangular flange configuration.

Interiorly of the enlarged receptacle 168, a conveyor assembly 186 is longitudinally mounted relative to the bottom wall 174. The conveyor assembly 186 is generally comprised of spaced-apart inner and outer, rotatably-mounted, vertical shafts 188 and 190 carrying sprockets 192 and 194 fixed to the respective upper ends thereof. The shafts 188 and 190 are rotatably mounted by bearing means 196 and 198 relative to the top wall 200 of a lowe housing 202, fixed to the receptacle bottom wall 174. The outer shaft 188 is provided with a collar 203 beneath the bottom wall 174. The inner shaft 190 is journalled in bracket means 204 bolted as at 206 relative to the bottom wall 174, and extends downwardly at 208 to carry a pulley 210 keyed thereto. A belt 212 extends from the pulley 210 at right angles around an adjustable double idler pulley 214 to a pulley 216 fixed to the outer end of the driven jaw shaft 102, (see FIG. 5).

A conveyor chain 218 is engaged about the sprockets 192 and 194 and carries a plurality of outwardly-extending, equally spaced-apart sweep plates 220 connected to the chain 218 by approriately configurated, right-angular bracket 222, each bracket having an upper, laterally inwardly-extending end 224 fixed to a link of the chain 218, a downwardly-extending, vertical, central portion 226, and a lower, outwardly-extending, lateral fork portion 228, fixed as by rivets 230 to one of said sweep plates. The conveyor sprockets 192 and 194 and the chain 218 are covered by an outer protective housing 232.

A second chute 234 connects between the outer housing 232 and the upper edge portion of the receptacle 168, said second chute comprising a downwardly and inwardly-inclined side plate 236 and a similar downwardly and inwardly-inclined inner end plate 238. The two inclined plates 236 and 238 serve to cover the inward run of the conveyor sweep plates 220 as well as the inner turn-around portion thereof. In other words, only the discharge run of the conveyor sweep plates 220 is exposed to shredded materials being gravity fed into the second chute 234 from the shredder jaw assembly 98 thereabove, so that this shredded material will be discharged through the opening 169.

As best illustrated in FIGS. 5 and 6, the speed reducer gear box 130 is provided with a screw rod and turnbuckle assembly as at 240, 242, 240, to tension the drive belt 126. The opposed ends of the screw rods 240, 240 are pivotally connected between a bracket 244 fixed relative to the bottom end of the secondary inner frame 138 and the gear box 130, respectively, to provide for rotational adjustment of said gear box about the axis of shaft 104 in the turnbuckle adjustment of the drive belt 126.

With reference to FIG. 8, a liquid catch basin 246 is fixed relative to an opening 248 in the bottom wall 174 of the receptacle 168, substantially in vertical alignment with the discharge run of conveyor 186. A top screen or perforated plate 250 is fixed within the opening 248, and a drain hose 252 is connected at 254 to a bottom outlet nipple 256 extendng from the catch basin 246 to direct the liquids from the catch basin into the dolly receptacle 68.

The solid waste shredder may be used either as an independent unit or, as illustrated in FIG. 1, an opening (not shown) may be provided in one sidewall of the compactor unit 12 to receive the rectangular flange 182 at the discharge end of receptacle 168. The compactor and shredder units may conveniently be positioned side-by-side, as illustrated, whereby all shredded materials are directly discharged from the shredder into the interior compacting chamber of compactor 12.

While I have herein illustrated and described a preferred form of my solid waste shredder device, it is to be understood that various changes and modifications can be made therein within the scope of the appended claims. For example, while the conveyor assembly for discharge of the shredded material is described and illustrated herein as being driven by the same electric motor that drives the shredder jaw assembly, it could alternatively be driven by a separate motor of comparatively small horsepower. The invention, in brief, comprises all the embodiments and modifications coming within the scope and spirit of the following claims.

What I claim as new and desire to secure Letters Patent is:

1. A portable waste shredder device comprising, in combination, an upstanding main shredder housing structure including a main framework defining a top charge opening means, and a discharge opening, a shredder jaw assembly comprising two sets of rotary jaws fixed, respectively, to a pair of parallel shafts, an electric motor, drive means from said electric motor to said pair of shafts for simultaneously rotating said parallel shafts in mutually opposite directions, a first chute means above said shredder jaw assembly to direct waste materials disposed in said top charge opening means into said shredder jaw assembly, a discharge opening, and means to deliver material shredded by said shredding jaw assembly through said discharge opening, said means to deliver said shredded material comprising a second chute means beneath said shredder jaw assembly, a conveyor means having a discharge run, an interior receptacle beneath said second chute means, the discharge run of said conveyor means being mounted in said interior receptacle, said conveyor means being positioned to discharge the shreds outwardly through said discharge opening, a liquid catch basin fixed relative to a bottom wall of said interior receptacle to receive all waste liquids from the shredder waste materials, a liquid receptacle means and drain means from said liquid catch basin to direct liquids into said liquid receptacle means.

2. A portable waste shredder device as defined in claim 1 wherein said top charge opening means comprises a horizontal open top defined by said main framework, and a top front door which pivots outwardly and downwardly of said horizontal open top.

3. A portable waste shredder device as defined in claim 1, including a bottom front opening in said housing member, said liquid receptacle means comprising a dolly removably receivable in said bottom front opening.

4. A portable waste shredder device as defined in claim 1, wherein said drive means includes a speed reducer transmission, a pulley drive from said electric motor to one of said pair of parallel shafts through said speed reducer transmission, and a first gear fixed to said one shaft in driving engagement with a second gear fixed to the other of said pair of shafts.

5. A portable waste shredder device as defined in claim 4, wherein said first and second gears are of different diameters to drive said pair of parallel shafts at non-synchronous relative speeds.

6. A portable waste shredder device as defined in claim 1, wherein said shredder jaw assembly comprises a set of rotary jaws fixed to each of said shafts in a spaced-apart relationship, said jaws being staggered along their respective shafts relative to each other and being spaced apart a distance sufficient to permit free overlapping, opposed rotational movement thereof, said pair of parallel shafts beng spaced apart a predetermined distance to provide for said overlapping relationship.

7. A portable waste shredder device as defined in claim 6, wherein said jaws are fixed to the respective shafts in abutting pairs in their spaced-apart staggered relationship.

8. A portable waste shredder device as defined in claim 6, wherein each of said jaws includes a main semi-circular body portion and an outwardly-projecting lobe providing a generally radially-extending leading face.

9. A portable waste shredder device as defined in claim 1, wherein said conveyor means comprises a horizontally mounted chain conveyor providing a plurality of outwardly-extending, spaced-apart, horizontal sweep plates fixed to the chain by bracket means, said chain being operably engaged around a pair of spaced-apart sprockets, said sprockets being rotatably carried by respective stub shafts journalled through the bottom wall of said interior receptacle and defining opposed discharge and return conveyor runs.

10. A portable waste shredder device as defined in claim 9, including a pulley drive means operably connecting between a downwardly extended end portion of one of said stub shafts and one of said parallel shafts.

11. A portable waste shredder device as defined in claim 1, wherein said pair of parallel shafts are rotatably journalled between front and back end plates, said end plates being fixed relative to the upper end of an inner, secondary frame means, said secondary frame means being resiliently fixed relative to said main framework, said electric motor being secured to mount means fixed relative to a lower end portion of said secondary frame means.

12. A portable waste shredder device as defined in claim 11, wherein said interior receptacle is secured to the bottom edges of said end plates.

13. A portable waste shredder device as defined in claim 1, wherein said second chute means comprises downwardly and inwardly inclined plate means for directing shredded materials into said conveyor discharge run.

14. A portable waste shredder device as defined in claim 1, wherein said top charge opening means comprises a horizontal open top defined by said main framework, and a top front door which pivots outwardly and downwardly of said horizontal open top.

15. A portable waste shredder device as defined in claim 1, wherein said drive means includes a speed reducer transmission, a pulley drive from said electric motor to one said pair of parallel shafts through said speed reducer transmission, and a first gear fixed to said one shaft in driving engagement with a second gear fixed to the other of said pair of shafts.

16. A portable waste shredder device as defined in claim 1, wherein said shredder jaw assembly comprises a set of rotary jaws fixed to each of said shafts in a spaced-apart relationship, said jaws being staggered along their respective shafts relative to each other and being spaced apart a distance sufficient to permit free overlapping, opposed rotational movement thereof, said pair of parallel shafts being spaced apart a predetermined distance to provide for said overlapping relationship.

17. A portable waste shredder device comprising, in combination, an upstanding main shredder housing structure including a main framework defining a top charge opening means, and a distance opening, a shredder jaw assembly comprising two sets of rotary jaws fixed, respectively, to a pair of parallel shafts, an electric motor, drive means from said electric motor to said pair of shafts for simultaneously rotating said parallel shafts in mutually opposite directions, a first chute means above said shredder jaw assembly to direct waste materials disposed in said top charge opening means into said shredder jaw asssembly, a discharge opening, and means to deliver material shredded by said shredding jaw assembly through said discharge opening, said shredder jaw assembly comprising a set of rotary jaws fixed to each of said shafts in a spaced-apart relationship, said jaws being staggered along their respective shafts relative to each other and being spaced apart a distance sufficient to permit free overlapping, opposed rotational movement thereof, said pair of parallel shafts being spaced a predetermined distance to provide for said overlapping relationship, each of said jaws including a main semi-circular body portion and an outwardly-projecting lobe providing a generally radially-extending leading face, the outer peripheral surfaces of said lobes being serrated.

* * * * *